United States Patent [19]

Okawa

[11] 3,993,446

[45] Nov. 23, 1976

[54] CEMENTED CARBIDE MATERIAL

[75] Inventor: Tadashi Okawa, Sakai, Japan

[73] Assignee: Dijet Industrial Co., Ltd., Osaka, Japan

[22] Filed: Nov. 7, 1974

[21] Appl. No.: 521,718

[30] Foreign Application Priority Data

Nov. 9, 1973 Japan ..... 48-126623

[52] U.S. Cl. ..... 29/182.7; 29/182.8

[51] Int. Cl.[2] ..... B22F 3/00

[58] Field of Search ..... 29/182.7, 182.8

[56] References Cited

UNITED STATES PATENTS

| | | | |
|---|---|---|---|
| 3,322,513 | 5/1967 | Corbett | 29/182.7 |
| 3,454,375 | 7/1969 | Montgomery | 29/182.8 |
| 3,552,937 | 1/1971 | Mito et al. | 29/182.7 |
| 3,628,921 | 12/1971 | Hill | 29/182.7 |
| 3,698,878 | 10/1972 | Hale | 29/182.7 |
| 3,746,519 | 7/1973 | Hara et al. | 29/182.8 |
| 3,816,081 | 6/1974 | Hale | 29/182.8 |

*Primary Examiner*—Benjamin R. Padgett
*Assistant Examiner*—Josephine Lloyd
*Attorney, Agent, or Firm*—Frank J. Jordan

[57] ABSTRACT

Cemented carbide material consists essentially of 70 to 90% by weight of tungsten carbide or of a mixture of tungsten and carbide at least one transition metal carbide, the transition metal being one other than tungsten selected from Groups IV to VI of the Periodic Table and 10 to 30% by weight of a binder. The binder contains 20 to 90% by weight of nickel, 10 to 80% by weight of cobalt and 5 to 25% by weight of chromium as the base ingredients thereof. The cemented carbide material has improved resistance to oxidation, to wear and especially to thermal cracking and is therefore suitable for rolls, guide rollers and dies for plastic hot working.

12 Claims, No Drawings

CEMENTED CARBIDE MATERIAL

The present invention relates to cemented carbide materials useful for rolls, guide rollers, dies and the like for plastic hot working which must be resistant to thermal cracking, oxidation and abrasion.

Cemented carbide materials for plastic hot working are generally used for hot rolling, hot extrusion and hot forging. When such a material is repeatedly subjected to thermal impact, oxidation and abrasion by contact with workpieces at 700° to 1200° C, cracks resembling a hexagonal or tortoise-shell pattern occur in its surface. These cracks further develop during use, with the result that the surface layer of the material is removed locally and is greatly reduced in strength. The resulting rough-surfaced cemented carbide material in turn renders the surface of the workpieces coarse and impairs the commercial value of the products. Accordingly high thermal crack resistance is the most important requirement for cemented carbides to be used for plastic hot working. In fact the properties of cemented carbides are directly dependent on this requirement.

The cemented carbide materials presently used for plastic hot working are simple WC-Co alloys which predominantly consist of WC and contain Co as a binder and which are therefore equivalent to WC-Co alloys heretofore used for cold working. Thus the WC-Co alloys adapted for cold working are merely applied to hot working with or without modifying the compositions thereof. The conventional materials are therefore subject to thermal cracking during an early stage of use, become rough-surfaced readily and unserviceable. Moreover the deep cracks created require the removal of a large amount of the surface layer by regrinding. Because of these drawbacks, the known materials are not fully satisfactory.

An object of this invention is to provide cemented carbide materials having improved thermal crack resistance and suitable for rolls, guide rollers, dies, etc. for hot working.

Another object of this invention is to provide cemented carbide materials which have improved resistance to oxidation and to abrasion as well as higher thermal crack resistance.

Another object of this invention is to provide cemented carbide materials having the foregoing improved properties without reducing the strength thereof.

The cemented carbide material of this invention consists essentially by weight of 70 to 90% of WC or of a mixture of WC and at least one transition metal carbide, the transition metal being one other than tungsten selected from Groups IV to VI of the Periodic Table, and 10 to 30% of a binder containing 20 to 90% by weight of Ni, 10 to 80% by weight of Co and 5 to 25% by weight of Cr as its base ingredients. Ni and Co are partially replaceable by Fe. In fact, Fe will be inevitably incorporated into the product according to the usual process for producing alloys.

The components of the cemented carbide material of this invention are essential for the following reasons.

Among the metal carbides, WC has the highest toughness and is excellent in hardness and in wear resistance and is resistant to mechanical impact. Accordingly alloys basically consisting of WC are used for abrasion-resistant impact-resistant tools for cold working, and WC alloys are similarly used for tools for hot working since they have the highest resistance to thermal impact. Part of the WC used in the cemented carbide material of this invention is replaceable by at least one of TiC, TaC, $Mo_2C$ and the like to prevent welding and adhesion during hot working and to improve resistance to oxidation and corrosion. Especially TaC is superior to WC in resistance to welding and adhesion, to oxidation and to abrasion and is almost as resistant as WC to thermal impact. The amount of WC replaceable by TaC is therefore difficult to define from the viewpoint of the properties of the resulting cemented carbide material and is limited only by economic reasons since TaC is more expensive than WC.

Titanium carbide substituted for WC improves resistance to welding and adhesion and oxidation resistance and is effective when used in a small amount for some applications but the use of TiC in a large amount seriously reduces the mechanical strength and is objectionable.

The amount of the binder is in the range of 10 to 30% by weight because if it is less than 10% by weight, the resulting cemented carbide material will have low resistance to thermal impact and become unserviceable, whereas when the amount is in excess of 30% by weight, the binder will have lower abrasion resistance, rendering the material similarly unfit for use.

The binder contains Ni which is very effective in improving thermal crack resistance. Generally Co is used as a binder in WC alloys to increase strength and hardness and to obtain an alloy of the most excellent quality. Indeed almost all wear-resistant impact-resistant tools for cold working contain Co as a binder. However when the tools are used in a hot oxidative environment, Co has the drawback of being readily susceptible to corrosion, as evidenced by the fact that alloys containing Co as a binder readily undergo thermal cracking. According to the invention predominant substitution of Ni for the Co binder used for the conventional alloy serves to give improved resistance to oxidation, which enhances thermal crack resistance. Furthermore, Ni is more resistant to oxidation than Co and exhibits excellent resistance under a highly corrosive environment in which both corrosive liquid and a high-temperature atmosphere are present as when cooling water is used for hot working. This is why Ni is incorporated as an essential ingredient. However, substitution of Ni for the entire amount of Co is not desirable, since Co has the highest affinity for WC, enhances the strength and hardness of the cemented carbide material obtained to improve resistance to accident and abrasion and is effective in stably maintaining the characteristics of the material as essentially required for the quality control of alloys. Thus both Ni and Co must be incorporated into the binder. Preferably the binder contains a greater amount of Ni than Co, the especially preferable ratio of Ni to Co being 2:1. The amount of Ni in the binder is 20 to 90% by weight, more preferably 30 to 65% by weight.

According to this invention Cr is a particularly important basic ingredient. Although it is known that Cr has excellent resistance to oxidation and corrosion, it has been merely used heretofore in small amounts generally as an agent for inhibiting the growth of WC crystals in WC-Co alloys, because it is in no way considered effective in improving the strength of alloys but is known as a component which reduces the strength. Thus Cr generally acts to impair the resistance to thermal impact, namely thermal crack resistance, thus an unobvious feature of this invention resides in that the amount of Cr as a component of the cemented carbide material is limited to ensure improved thermal crack resistance. Indeed the above-mentioned drawback of Cr that it reduces the strength of the alloy is insignificant in view of the useful advantages achieved by the addition of Cr as will be described below.

Firstly Cr enhances the resistance to oxidation and abrasion resistance. Generally the smoother the surface of cemented carbides, the higher will be the resistance to cracking, so that the increased resistance to oxidation and to surface corrosion resulting from the use of Cr permits the cemented carbide material to maintain good surface conditions for a prolonged period of time and to have the correspondingly greater thermal crack resistance.

Secondly use of Cr effectively renders the WC particles round-shaped. Whereas stress tends to concentrate on sharp ends of WC crystals, nearly spherical WC particles reduce the possibility of thermal cracking, giving the material higher thermal crack resistance.

Thirdly addition of Cr causes a peculiar segregation of the binder phase in the cemented carbide material. Inasmuch as the segregation of the binder phase lowers the strength and hardness of the material, it is generally believed in the art that the occurrence of such segregation must be avoided in the production of cemented carbides for quality control. The unobviousness of this invention resides in that the segregation of the binder phase is intentionally produced and is utilized to improve thermal crack resistance.

With cemented carbides mainly consisting of WC which is a hard substance, and a binder, thermal impact is mainly absorbed by the binder.

Empirical data indicate that the coarser the particles of the carbides, the higher is the resistance of the resulting cemented carbide material to thermal impact. In other words, the larger the thickness of the binder phase, the higher is the resistance of the material to thermal impact and to thermal cracking. Put in detail, the fact that the binder phase easily absorbs the energy of thermal impact without being broken down means that the binder phase readily undergoes elastic and plastic deformation. The amenability to elastic and plastic deformation can be determined most easily by measuring the hardness. The results of basic experiments carried out for this invention revealed that the lower the hardness, the higher is the resistance to thermal impact. Cemented carbide materials having a segregated binder phase produced by the addition of Cr according to this invention generally exhibited 1 to 3 lower hardness as determined by Rockwell A scale and achieved outstanding results when tested for use as a hot working roll. It was also found that the segregated binder phase had a thickness more than ten times the thickness of the binder phase in a WC-Co alloy containing the same amount of binder. These findings indicate that the energy of thermal impact can be absorbed most effectively by the segregated portion of the cemented carbide material of this invention.

If the amount of Cr is less than 5% by weight based on the binder, effective results are unavailable, whilst if it is in excess of 25%, many voids or pores are produced in the cemented carbide material with marked deterioration in the strength of the material and a great increase in the hardness thereof, resulting in poor thermal crack resistance. Accordingly Cr is used preferably in an amount of 5 to 25% by weight, more preferably 10 to 15% by weight, based on the binder.

Examples of this invention will be given below.

Used as finely divided starting materials were 3- to 6-micron WC powder, 0.8- to 2-micron Ni powder, 0.8- to 2-micron Co powder and minus 200-mesh Cr powder. Six-inch hot working rolls and hot extruding dies were prepared by the usual process for producing cemented carbides including the steps of mixing, pressing, vacuum presintering, molding and vacuum sintering.

Table 1 shows the compositions of cemented carbide materials according to this invention and those of cemented carbides prepared for comparison. Table 2 gives the results obtained by using the hot working rolls for the production of rolled steel wires at a temperature of 1,050° C. Listed in Table 3 are the results obtained by using the hot extruding dies for producing brass extrusions at a temperature of 700° C.

Table 1

| No. | Composition (wt. %) WC | TaC | TiC | Ni | Co | Cr | Note |
|---|---|---|---|---|---|---|---|
| R1 | 80 | 3 | — | 10 | 5 | 2 | Hot working roll (this invention) |
| R2 | 72 | | — | 16 | 8 | 4 | " |
| R3 | 83 | — | — | — | 17 | — | Hot working roll (for comparison) |
| R4 | 72 | 3 | — | — | 25 | — | " |
| R5 | 85 | — | | 15 | — | — | " |
| R6 | 82.5 | — | | 10 | 7 | 0.5 | " |
| R7* | 70 | — | | 15 | 7 | 8 | " (reject) |
| D1 | 76 | 5 | 3 | 6 | 8 | 2 | Hot extruding die (this invention) |
| D2 | 76 | 5 | 3 | — | 16 | — | Hot extruding die (for comparison) |
| D3 | 85 | — | — | — | 15 | — | " |

*When inspected after sintering, the roll R7 was found to have many voids and was rejected without testing.

Table 2

| No. | Rolled amount* (tons) | Amount** removed by re-grinding (mm) | Note |
|---|---|---|---|
| R1 | 1800 | 1.1 | this invention |
| R2 | 1900 | 1.1 | " |
| R3 | 1200 | 1.3 | for comparison |
| R4 | 1500 | 1.3 | " |
| R5 | 1400 | 1.3 | " |
| R6 | 1200 | 1.3 | " |

*By the term "rolled amount" is meant the amount of rolled steel wires in tonnage produced by the rolls before the roll surfaces became so rough-surfaced as to require re-grinding.

**The amount removed by re-grinding is expressed in terms of reduction in the outer diameter of the roll necessary to completely eliminate heat cracking.

Table 3

| No. | Total* amount of extrusions (tons) | Number of** re-grinding operations | Note |
|---|---|---|---|
| D1 | 170 | 25 | this invention |
| D2 | 30 | 6 | for comparison |
| D3 | 20 | 4 | " |

*Total amount of extrusions is that of the brass extrusions produced by the hot extruding die before it was discarded.

**when the bore diameter increased due to roughening of the surface and abrasion, the die was re-ground to a greater bore diameter. The table gives the number of such re-grinding operations repeated until the die became no longer serviceable even by re-grinding.

Tables 1 to 3 show that the cemented carbide materials of this invention have outstanding properties heretofore unavailable. Table 2, for example, indicates that although the cemented carbide materials of this invention are capable of producing increased amounts of rolled wires, thermal cracks created therein are shallower than the comparison specimens and can be eliminated by removing a smaller amount of the surface layer. Furthermore Table 3 reveals that the cemented carbide materials of this invention give exceedingly increased amounts of extrusions. The titanium carbide used in these cemented carbide materials of the invention serves to improve the resistance to welding and adhesion and to oxidation.

The various effects achieved by Ni, Co and Cr to prevent occurrence of heat cracking enable the cemented carbide materials of this invention to have greatly increased thermal crack resistance and impart to the materials excellent properties which are about 1.2 to 6 times as high as those of conventional like materials. When used for guide rollers for hot working, the present materials also exhibit remarkable properties. Thus the cemented carbide materials according to this invention are very useful for various tools and parts for plastic hot working.

What is claimed is:

1. A cemented carbide material consisting essentially by weight of 70 to 90% of a carbide selected from the group consisting of tungsten carbide and a mixture of tungsten carbide and at least one transition metal carbide, the transition metal being one other than tungsten selected from Groups IV and VI of the Periodic Table, and 10 to 30% of a binder containing by weight 20 to 90% of nickel, 10 to 80% of cobalt and 5 to 25% of chromium as the base ingredients thereof, whereby said cemented carbide material has improved resistance to thermal cracking and is useful for plastic hot working.

2. The cemented carbide material as set forth in claim 1 wherein the transition metal carbide is tantalum carbide.

3. The cemented carbide material as set forth in claim 1 wherein the transition metal carbide comprises a mixture of tantalum carbide and titanium carbide.

4. The cemented carbide material as set forth in claim 1 wherein the binder contains 30 to 65% by weight of nickel.

5. The cemented carbide material as set forth in claim 1 wherein the binder contains 10 to 15% by weight of chromium.

6. The cemented carbide material as set forth in claim 2 wherein the binder contains 30 to 65% by weight of nickel.

7. The cemented carbide material as set forth in claim 2 wherein the binder contains 10 to 15% by weight of chromium.

8. The cemented carbide material as set forth in claim 2 wherein the binder contains 30 to 65% by weight of nickel and 10 to 15% by weight of chromium.

9. The cemented carbide material as set forth in claim 1 wherein the binder contains a greater amount of Ni than Co.

10. The cemented carbide material as set forth in claim 9 wherein the binder contains Ni and Co in a ratio of 2:1.

11. The cemented carbide material as set forth in claim 2 wherein the binder contains a greater amount of Ni than Co.

12. The cemented carbide material as set forth in claim 11 wherein the binder contains Ni and Co in a ratio of 2:1.

* * * * *